US005217369A

United States Patent [19]

Brown et al.

[11] Patent Number: 5,217,369

[45] Date of Patent: Jun. 8, 1993

[54] ATMOSPHERIC FURNACE DOOR COUNTERBALANCE

[75] Inventors: Dix Brown; Nathan P. Lee; Willard L. Hofer, all of Boise, Id.

[73] Assignee: Micron Techology, Inc., Boise, Id.

[21] Appl. No.: 890,506

[22] Filed: May 28, 1992

[51] Int. Cl.[5] ..... F27D 1/18

[52] U.S. Cl. ..... 432/250; 110/173 R; 432/253

[58] Field of Search ..... 110/173 R, 176; 432/250, 253; 202/242, 248, 246

[56] References Cited

U.S. PATENT DOCUMENTS 4,073,697 2/1978 Prötzl ..... 202/242 X
4,596,197 6/1986 Kinzler ..... 110/173 X
4,979,897 12/1990 Yates ..... 432/250

*Primary Examiner*—Edward G. Favors
*Attorney, Agent, or Firm*—Wayne E. Duffy

[57] ABSTRACT

An improved apparatus is described for the closure of the open end of a conventional tube furnace used in the treatment of semiconductor devices manufactured in the integrated circuit industry. The apparatus consists primarily of an adjustable fixed weight on one end of a lever arm and a roller bearing means on the other end, said lever arm being supported by a fulcrum structure which is adjustably attached to the movable track which transports the semiconductor devices into and out of the furnace. The roller bearing end of the lever arm rests with constant pressure against the rear face of the furnace door when the door is closed and held against the opening in the tube furnace. The design eliminates the need for springs and is insensitive to the environment.

1 Claim, 6 Drawing Sheets

ATMOSPHERIC FURNACE DOOR COUNTERBALANCE

BACKGROUND OF THE INVENTION

This invention relates to end closure means for controlled environment furnace tubes used in the manufacture of semiconductor devices in the integrated circuit industry.

DESCRIPTION OF PRIOR ART

Furnace tubes used in heating semiconductor wafer parts in their manufacturing processes usually have positive controlled atmosphere environment as well as high temperature, both of which are generally confined within the dimensions of the tube furnace. While gas tightness is not always achieved and not necessarily desired, the closing of the end of the tube is usually accomplished by means of a spring loaded door which presses against an open end of the heated furnace tube. Because of the heat from the interior of the tube, which is transmitted to and through the movable door, the sealing mechanism, commonly a corrosion resistant spring which is sensitive to the heat, usually loses its elasticity in a relatively short time. This results in loss of reproducible compressive force on the door against the end of the furnace tube, possible incomplete end closure and unpredictable and undesirable change in the controlled environment for the furnace.

Search of patent literature reveals a large variety of door closure devices for heated environments. These usually combine a counterweight or counterbalance means with a conventional compressible spring assembly to close the door against the oven or other inclosed volume. The door is usually designed to operate in a horizontal or vertical plane and may be aided by gravity in some cases, depending upon the specific design. Latching devices are often included to secure the door in position, particularly when inclosed environment integrity is required.

The common shortcoming of most of the door closure designs involves the durability and reliability of the spring assembly which is exposed to the end conditions of the heated environment. The springs usually lose elasticity due to the high temperature which reaches the spring, usually by conduction or radiation of heat from the enclosed environment, as described above. Even so, in the absence of a latching mechanism to maintain door closure, which may be undesirable or impractical in many operational situations, the compressible spring-counterbalance combination becomes the common method of door closure. When the spring fails the door seal deteriorates and the enclosed environment integrity is endangered. Such unpredictability of environment control naturally affects the uniformity of any product, such as a semiconductor wafer, which may be treated in such a system.

It is a purpose of this invention to eliminate such variability and to insure a uniform manufactured product.

SUMMARY OF THE INVENTION

This invention comprises an atmospheric door counterbalance means which is designed to maintain a constant, controllable pressure between the door and the end of a furnace tube which is used in the manufacture of standard semiconductor wafer parts in the semiconductor industry. It consists primarily of a suitable, fixed weight which is removably and adjustably fixed on one end of a lever arm, which rests upon a fulcrum of suitable design. The opposing end of the lever arm has a cross bar attached thereto, with rollers axially placed on opposing ends of the cross bar which maintain rolling contact with the outside surface of the furnace door during opening, closing and holding operations of the door. All parts of the counterbalance and associated hardware, to be described, are composed of a suitable metal or other material which can withstand a corrosive environment and the high temperatures normally encountered in such furnace operation, without warping, weakening or otherwise failing. The use of springs is avoided altogether.

This invention has the advantage of adjustability. The sealing force on the door may be changed by selectively moving the counter balance weight along the axis of the lever arm or by choosing a different weight or by both means. This invention has a further advantage of consistency. The counter weight is not affected by extremes of heat or corrosive environments. This invention has the advantage of flexibility. It has few restrictions on placement because it only requires contact with the sealing surface. There is no other mechanical linkage. Thus it is very portable and multiple systems could be used for a variety of individual purposes on a single sealing surface, if desired. A further advantage of this invention is the ability to monitor the position of the lever arm/counter weight visually or by other mechanical, optical or electrical means in order to verify the position of the cover and the integrity of the seal against the chosen environment.

DESCRIPTION OF PREFERRED EMBODIMENTS

Figure 1:
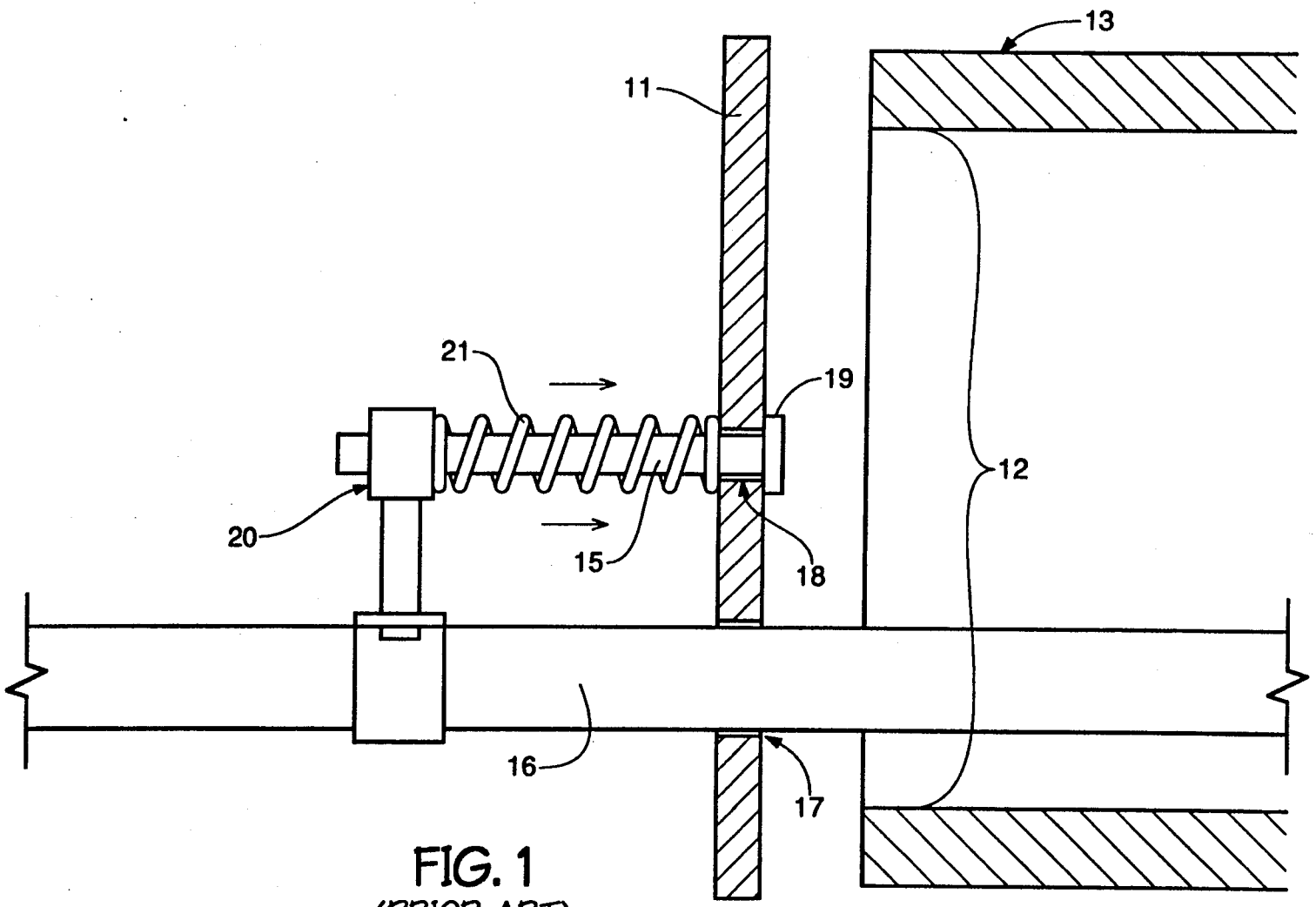
FIG. 1 (PRIOR ART)
FIG. 1 is a schematic side view of a typical prior art door assembly shown approaching the open end of a typical tube furnace, on a moving track, with coiled springs circumscribing quartz rods which support the door.

The first preferred embodiment consists of a novel device, herein designated by the number 10, designed to replace an existing system of springs and rods, which held an existing, movable, circular disc shaped quartz door 11 against the open end 12 of an existing, horizontally oriented, cylindrical quartz tube furnace 13. The invention 10 may be seen in an isometric view in FIG. 4, which shows, in a manner to be described, the quartz door approaching, on an existing track 16, the open end 12 of the horizontally oriented quartz tube furnace, while being held in a vertical plane, in a known way, by parallel spaced, horizontally oriented, quartz rods 15. The vertical, parallel leading and opposing faces of the door are parallel to the open end of the tube furnace. The tube furnace and the quartz rods and the quartz door and the track are of known design and are not a part of this invention.

Figure 2:
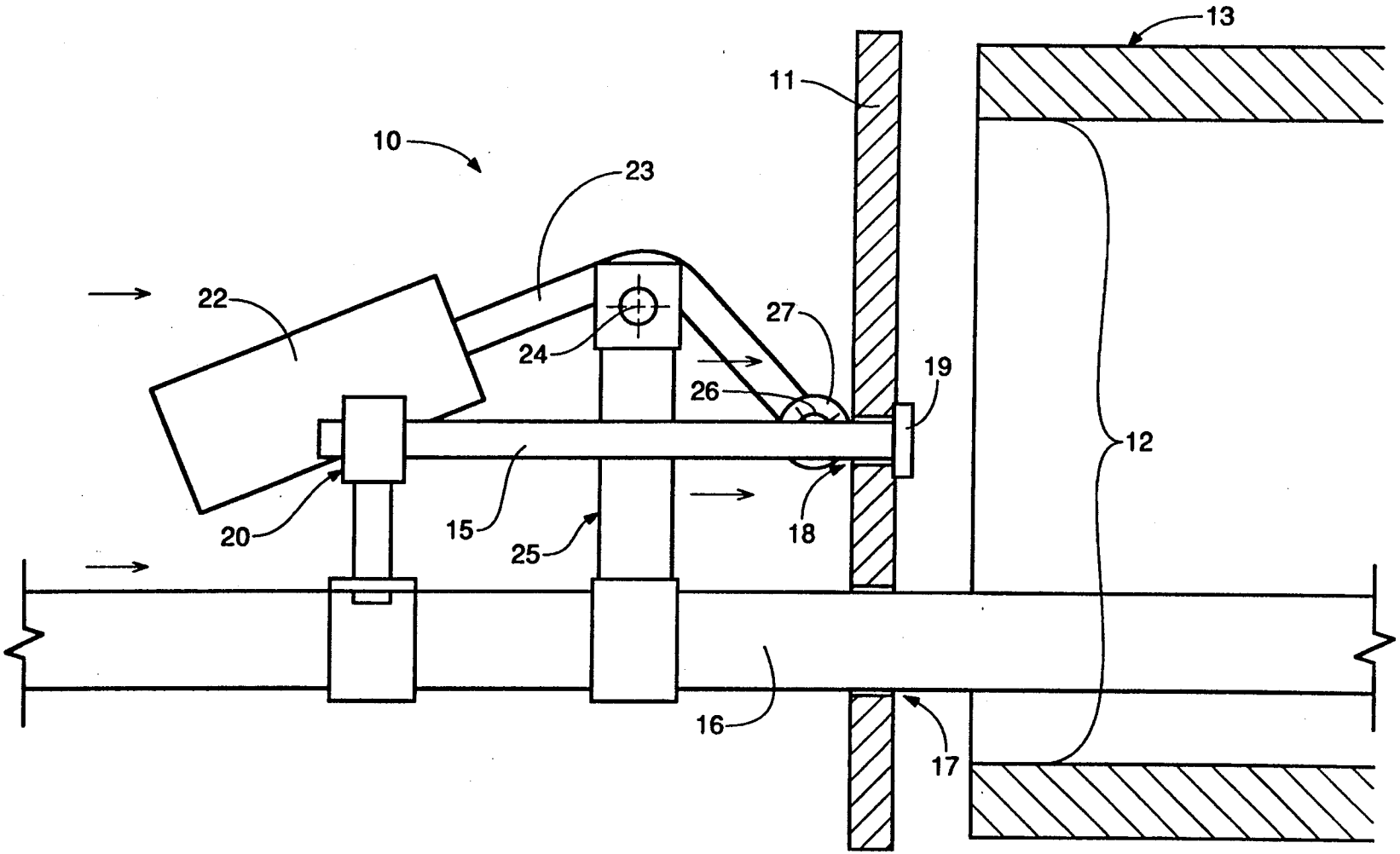
FIG. 2 is a schematic side view of a door assembly in a preferred embodiment, with the door being held in extended position prior to closing, by a movable counter balance weight.
Figure 4:
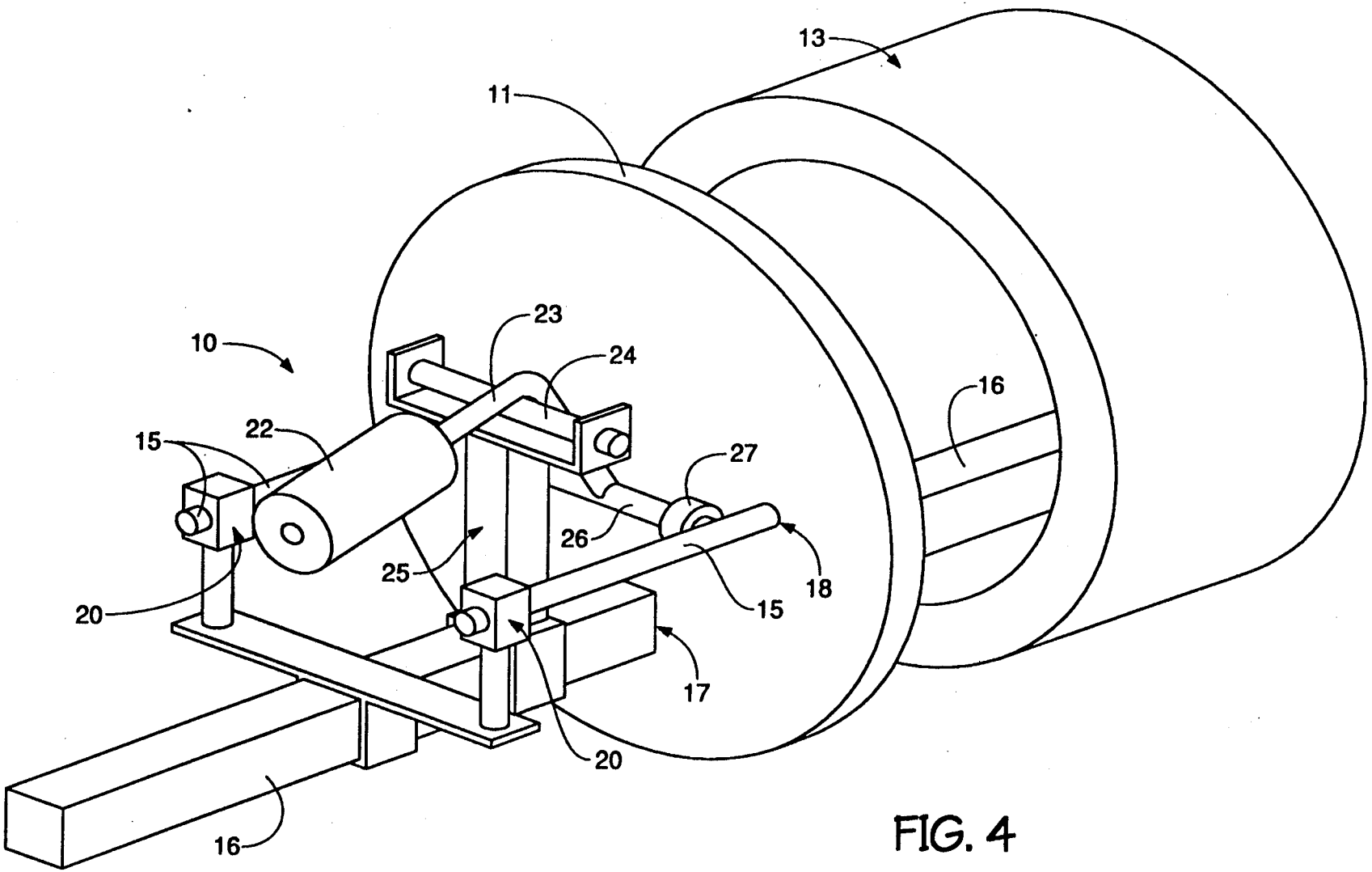
FIG. 4 is an isometric view of a furnace door prior to closing of the open end of the tube furnace.

FIG. 2 shows a schematic side view of an existing door 11 being held in a vertical plane, generally parallel to the open end 12 of an existing tube furnace 13. A generally rectangular opening 17 in said door, as shown in FIG. 4, circumscribes closely said existing track 16, which moves controllably and in a known manner, forward and backward along an axis between and parallel to the central, horizontal axis of the tube furnace and the lower parallel, inner surface of the tube furnace. Said track is designed to transport the integrated circuit carrying wafers, not shown, in and out of the tube furnace, in a known and controlled manner during the known manufacturing process. The opening 17 in the door is shaped in a known manner to closely circumscribe the horizontal track but still allow sufficient clearance between the inner surfaces of the rectangular opening in the door and the external dimensions of the track for limited, horizontal movement of the vertically oriented door, to permit sealing closure of the circular door against the matching circular open end of the tube furnace, when the moving track carries the door and closure means, in a known way, toward the open end of the tube furnace. The moving track has an automatic stopping means, of known design, not shown, which prevents further forward movement of the track and door and closure means when door closure is accomplished.

Figure 3:
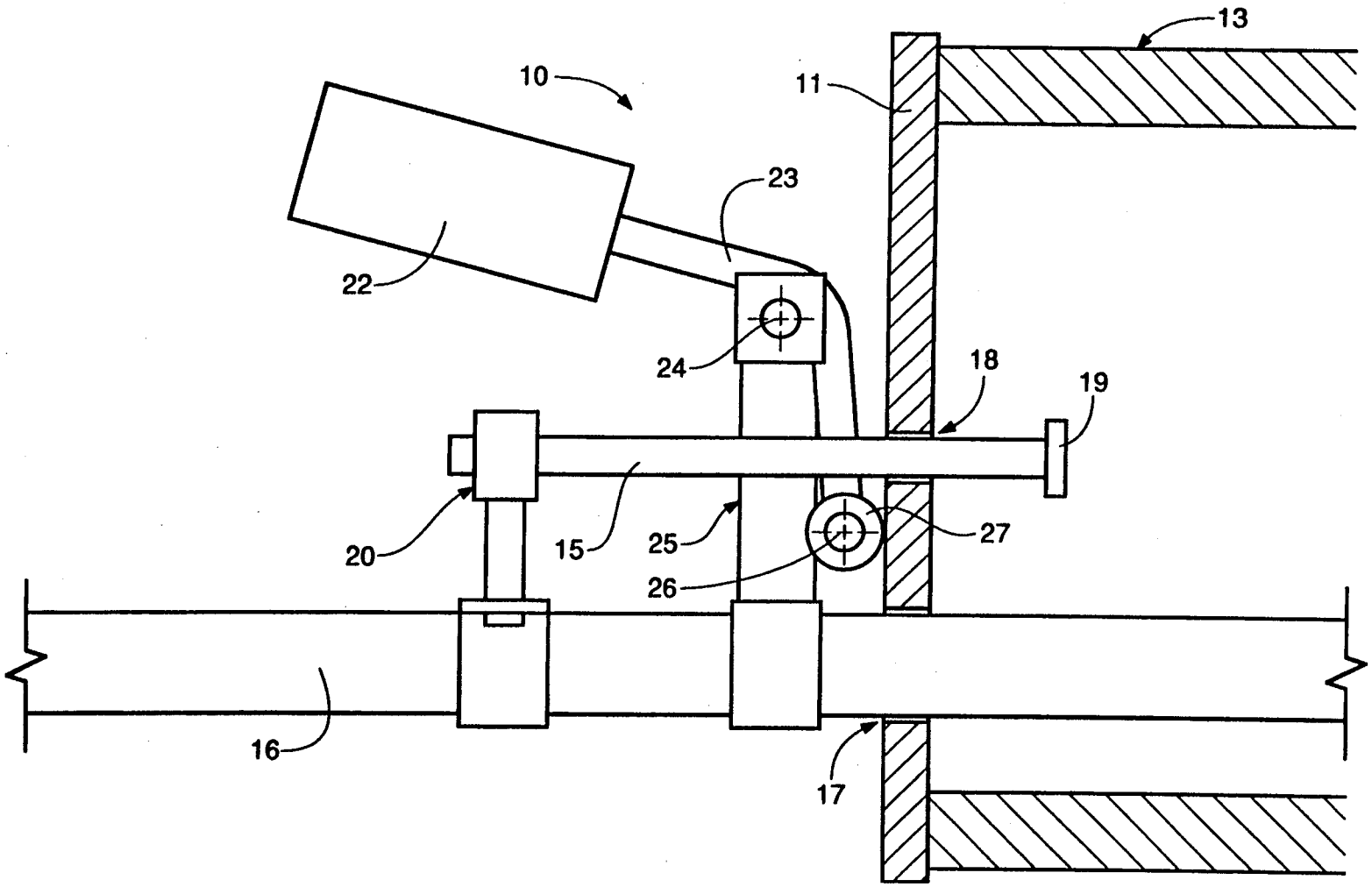
FIG. 3 is a schematic side view of a preferred embodiment door assembly with the door being held in closed position by a movable counter balance weight.

In the first preferred embodiment the circular quartz door is held and supported in an approximately vertical position by two existing, horizontally oriented cylindrical quartz rods 15 which are parallel to each other and spaced laterally equidistant from and in the same plane as the central axis of the tube furnace. Each of these rods extends through a separate circular opening 18 in the quartz door, as seen in FIGS. 3 and 4, which circumscribes closely the rod, allowing sufficient clearance around the rod for limited horizontal movement of the vertically oriented door to permit sealing closure of the circular door against the matching circular open end of the tube furnace.

The existing quartz rods are designed and formed in a known way to have one end of slightly larger diameter than the rod to provide a cap 19 with a flat square shoulder which will bear against the leading surface of the door and serve to pull the door back from the open end of the furnace when the track movement is reversed in a known way to open the door and withdraw the contents of the tube furnace. The other, opposing end of each rod is inserted into a supporting frame 20 of known design and removably secured thereto by a setscrew or other means not shown, to maintain a predetermined length for the rods. The support frame is removably attached to the travelling track in a predetermined position. The rods and supporting frame are prior art and not a part of this invention.

In prior art, as shown in Figure each rod is circumscribed axially by a coil spring 21 of known composition which extends from the rear, exterior face of the quartz door, on one end, to the leading face of the rod support structure on the other end. This spring, on each rod, serves to compress the door against the shoulder of the support rod cap 19 when the door is in the open position, as seen in FIG. 1 and to hold the door against the face of the furnace when the door is in the closed position. Any escaping furnace heat being transmitted through the door tends to cause the springs to lose elasticity and eventually to fail, thereby affecting the sealing closure of the furnace and integrity of the environmental conditions within the furnace.

Referring again to FIG. 2, the invention, herein designated by the number 10, comprises a fixed weight 22, a lever arm 23, a fulcrum 24, a fulcrum support structure 25, a cross-bar 26, with rollers 27 on opposing ends of the cross-bar, all operably connected to each other in a manner to be described.

The fixed weight 22, in the preferred embodiments, is chosen to be of sufficient size and dimension to exert enough force through the selected lever arm to close and adequately seal the quartz door against the open end of the tube furnace. In the preferred embodiments, a resultant closing force of approximately five pounds, applied in a vector parallel to the central axis of the tube furnace, was found to be sufficient to seal the door satisfactorily for the conditions encountered in the furnace operation.

In the preferred embodiments the fixed weight 22 is composed of a suitable heavy metal, chosen to withstand the environmental conditions. This weight is shaped in the form of a cylinder which is removably and adjustably attached along its central axis, in a known way, here a threaded connection, not shown, to one end of a lever arm 23. This lever arm is also composed of a metal material suitable to withstand the environment. The lever arm is threaded on one end, not shown, and is generally shaped as a cylindrical rod. On the end of the rod opposing the attached weight is fixedly attached a cross-bar 26, again composed of suitable metal material to withstand the environment. This cross-bar extends equilaterally, horizontally and normal to central axes of the track and the tube furnace. On each opposing end of the cross-bar a roller bearing means 27 of suitable design and composition is removably and operably attached, to rotate freely about the long axis of the cross-bar and whose outer, cylindrical surfaces are aligned to bear upon the rear, flat parallel surface of the quartz door.

The lever arm 23, in the preferred embodiments, is removably attached at a pre-selected point upon a fulcrum, 24, which consists of a cylindrical rod, extending horizontally and normal to the long axis of the lever arm and the central axis of the tube furnace. The fulcrum is supported on its opposing ends by and rotatably and removably attached to arms of a pedestal support structure 25, of suitable metal material, which is removably and adjustably attached on its opposing end to the movable track 16 by a C-clamping means, not shown, which forms an integral part of the pedestal support means.

In the preferred embodiments the lever arm 23 is bent downward at an appropriate angle at a point approximately midway between its two opposing ends, with the interior apex of the angle forming a radius which conforms with the circumferential surface of the fulcrum, thereby allowing the removably attached lever arm to move easily and smoothly with the rotating fulcrum when the quartz door is being closed or held or opened, in the operation of the tube furnace. In order to ensure that the door will be held in approximately vertical alignment during the closing and opening steps, the uppermost point of horizontal contact of the roller bearing means 27 with the surface of the door shall not be above the middle of the door and preferably should be slightly below the middle. This is required in order that the roller bearing means will move in a downward direction and the counter weight will rise when the door is moved from the open to the closed position during the forward movement of the track into the furnace.

In the first preferred embodiment, as seen in FIG. 2, the quartz door is limited in its fully extended position, with relation to the fulcrum support structure, by the end caps 19 of the quartz rods 15. The lengths of the rods are equal and are set by the sliding adjustment, in a known way, of the rods in the existing rod end support structures 20, which, in turn, are movably and adjustably attached by a C-clamping means, not shown, on their opposing ends, to the track 16.

Referring to FIG. 3, when the movable track 16, bearing the load of integrated circuit wafers being treated in the furnace, not shown, has been advanced to its preset position, the door 11 has been advanced to the closed position against the open end of the tube furnace. As the door closes against the end of the tube furnace, the moving track continues to move the fulcrum and counter weight means toward the door. As shown in FIG. 3, the quartz rods continue to slide through the door for a short, preset distance and the counter weight on the one end of the lever arm rises as the roller bearing means on the cross-bar on the opposing end of the lever arm roll downward along the face of the door. During the operation of the tube furnace the fixed counter weight will hold the door closed with a constant pressure. When the furnace operation is completed the track 16 is moved controllably, in a known way, in the reverse direction and the door is opened by being pulled axially and horizontally away from the open end of the tube furnace by the end caps 19 on the quartz rods, which action is prior art.

The travel distance of the track 16 which holds the IC wafers, not shown, is preset by a mechanical stopping means, not shown, in a known way, not a part of this invention. The door and counter weight means are placed on the track in an adjustable and removable manner and in a location which allows the door to close against the end of the tube furnace without excessive pressure, which might break the door or the tube. The track then continues to move a short distance further, thus permitting the counter weight to adjust the closing and sealing pressure between the door and tube end. The additional distance of travel and the precise locations on the track of the door and the counter weight means and the quartz rods are determined by the design of the means and will vary according to the requirements of the user.

Figure 5:
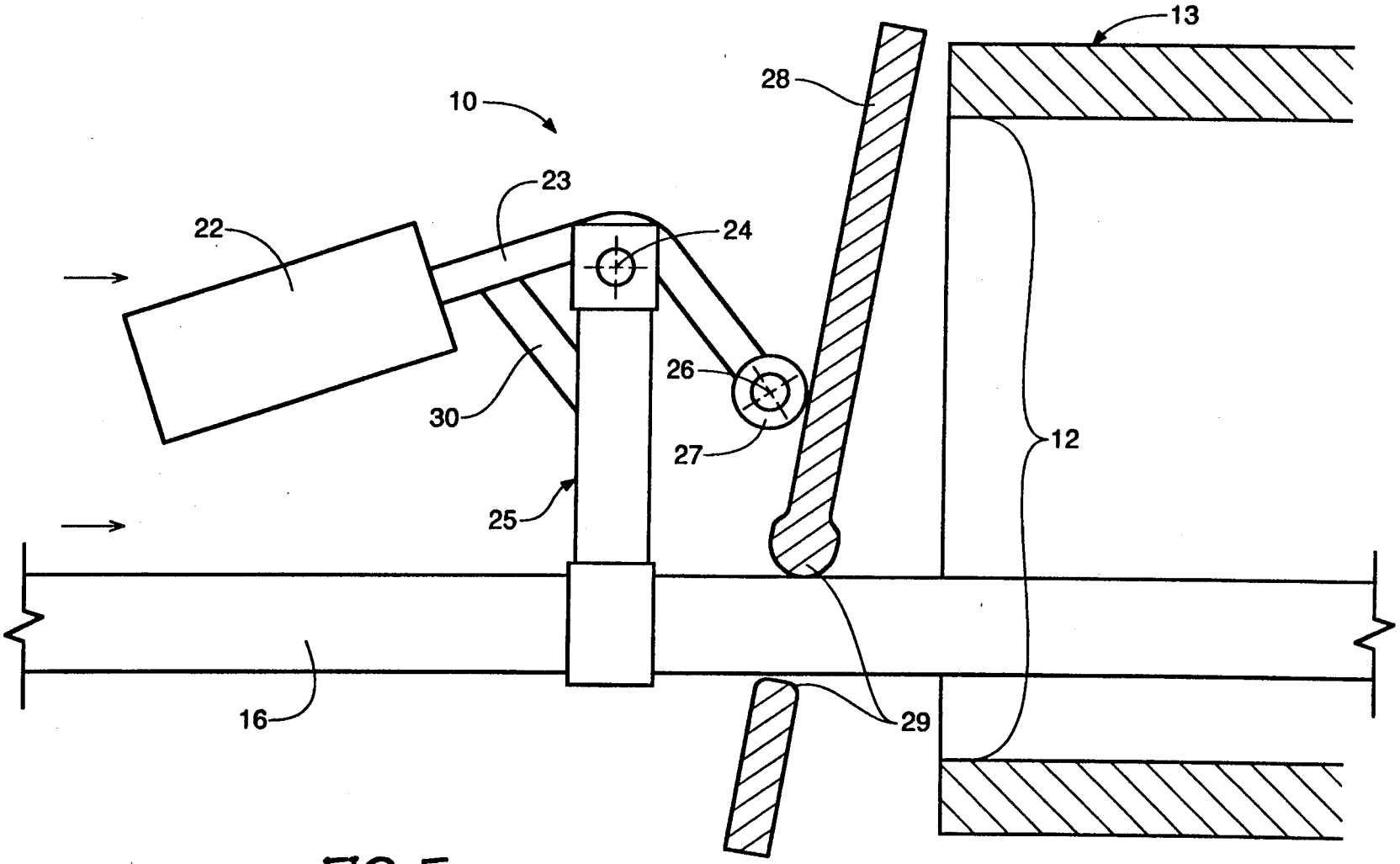
FIG. 5 is a schematic side view of a second preferred embodiment showing a door being freely supported by the track and being moved along the track by a counter balance assembly toward the open end of the tube furnace.

The second preferred embodiment eliminates the need for the supporting and holding quartz rods, which were present in the prior art and are not a part of this invention. In this embodiment, as shown in FIG. 5, the quartz door 28 is shaped, as before, as a flat disc, with flat, parallel, opposing leading and following surfaces and has a generally rectangular opening, as before, in the lower portion of the door, which closely circumscribes the rectangular track. In this embodiment the door rests upon the track. The opposing, upper and lower parallel surfaces of the opening in the door are appropriately rounded 29 on their leading and following edges to allow the door to rock slightly, forward and backward, when the door is being closed or opened in the furnace operation. The rounded edges also reduce the tendency of the quartz to chip or break during the operation of the door and prolong the useful life of the door. This modification is not a part of this invention.

Figure 6:
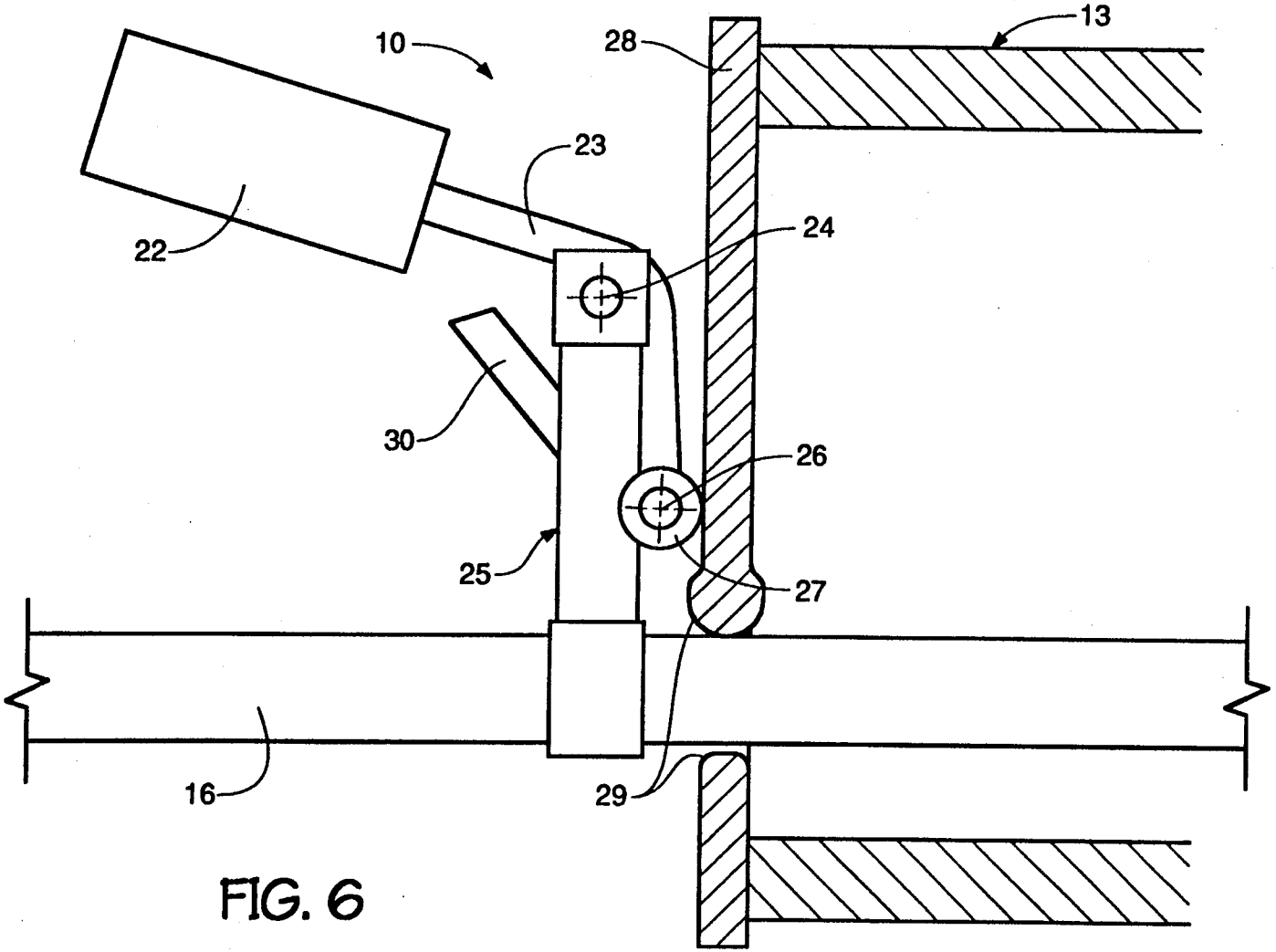
FIG. 6 is a schematic side view of the second preferred embodiment showing the door in closed position.

Referring again to FIG. 5, when the track is moving forward during the introduction of the IC wafers into the furnace, the door rests motionless upon the track. The top of the door is tilted slightly forward by the force of the counterweight means against the following surface of the door. The track continues to move forward, with the racks of IC wafers, not shown, to a preset position. During the last small increment of travel of the track, which is determined by the user, the upper leading surface of the quartz door touches the upper surface of the face of the open end of the tube furnace. The continuing incremental travel of the track and the pressure of the counter weight causes the quartz door to slide forward on the track and to assume a position in which the leading surface of the door is in a vertical plane and parallel to the plane of the open end of the tube furnace. Further travel of the track and the sliding door, which is being pressed by the counterweight, causes the door to seal against the open end of the tube furnace, as shown in FIG. 6.

The final increment of travel of the track, which is determined by the user, causes the counter weight to adjust slightly, with the roller bearing means moving slightly downward and the counter balancing weight moving slightly upward. The final positions of the roller bearing means and the counterbalancing weight, as set by the user, produce a predictable, reproducible, appropriate, constant resultant force to hold the quartz door against the open end of the tube furnace during the standard, known operation of the furnace, which is not a part of this invention.

When the furnace operation is completed, the track holding the treated IC wafers is moved by known means, not shown, in a reverse direction. This causes the counter balance means also to move in the reverse direction. This then causes the roller bearing means to move upward along the following face of the door and for the door to tilt forward. This action plus the friction of the door upon the track surface results in the door moving away from the open end of the tube furnace and resting motionless upon the track as it moves out of the furnace.

In this second preferred embodiment the downward arc of movement of the counter balance weight about the axis of the fulcrum is limited by an adjustable and removable mechanical supporting means 30, which prevents the weight from causing the roller bearing means from rising above the midpoint of the face of the quartz door. As discussed previously, such a consequence would create a malfunction of the door during the next closing operation.

The present invention has been described in a preferred embodiment which adapts to current technology in a novel manner and in a novel, simpler, variation of that embodiment, but many modifications and variations may become apparent to those skilled in the art. However, the scope of the invention is not limited by the above described details but only by the appended claims.

We claim:

1. An end closure apparatus for horizontally oriented, controlled environment, furnace tubes used in the manufacture of semiconductor devices in the integrated circuit industry, the apparatus comprising:

a. a lever arm having a selected fixed weight removably and adjustably attached to on end thereof and a horizontal cross bar fixedly attached to the opposing end thereof, in a position normal to the long axis of the lever arm;

b. said cross bar having roller bearing means removably and axially attached on opposing ends of said cross bar, in order to exert rolling force normal to the long axis of said cross bar and against the vertical face of an existing door and open end of an existing furnace;

c. said lever arm being bent at a chosen angle, in a vertical plane, at a selected point between the opposing ends of the lever arm in order to form a fulcrum point for application of leverage;

d. said lever arm being removably held and supported at said fulcrum point by a suitable fulcrum which rolls upon and is removably held by a fulcrum supporting means which is removably and adjustably attached to the existing movable track of a horizontally oriented tube furnace to allow the lever arm to move freely up and down in a vertical plane;

e. said fulcrum supporting means having a lever arm movement limiting means adjustably attached thereto to prevent the upward movement of the cross bar roller bearing means on said lever arm from rising above the vertical mid point of the existing furnace door, which is supported and slidingly held by the movable track, in a generally vertical plane during the operation of the end closure apparatus and the tube furnace;

f. said end closure apparatus thus being removably, adjustably and selectively attached to the existing movable track, which moves devices into and out of the tube furnace during the operation of said furnace, in order to apply a horizontal, forward directed, uniform, controllable force parallel to the central axis of the tube furnace, to close and hold the existing furnace door firmly against the open end of the tube furnace during such operation;

g. said furnace operation commencing when the moving track carrying the devices to be treated in said furnace, simultaneously moves the existing door and the end closure apparatus toward the open end of the tube furnace, to a preset position, causing the furnace door first to touch the face of the furnace opening and the roller bearing means of the lever arm to move downward along the generally vertical face of the furnace door, while exerting a closing and holding force against the tube furnace, which force causes said door to slidingly close against said furnace opening and to be held firmly and uniformly in such position by the leveraged force of the counter balance weight on the opposing end of the lever arm;

h. upon completion of furnace operation, when said movable track is moved in a reverse direction during the extraction of the treated devices, said counter balance weight also moves in a reverse and downward direction and said roller bearing means move upward to a preset position below the mid point of the door, to prevent malfunction of the apparatus during the next furnace operation cycle, and the door rests upon and moves backward with the moving track and away from the open end of the furnace.

* * * * *